US010449767B2

(12) United States Patent
Fujioka et al.

(10) Patent No.: US 10,449,767 B2
(45) Date of Patent: Oct. 22, 2019

(54) LIQUID EJECTING APPARATUS AND CLEANING DEVICE

(71) Applicant: SEIKO EPSON CORPORATION, Tokyo (JP)

(72) Inventors: Kazuyuki Fujioka, Matsumoto (JP); Ryoji Fujimori, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/703,237

(22) Filed: Sep. 13, 2017

(65) Prior Publication Data

US 2018/0001645 A1 Jan. 4, 2018

Related U.S. Application Data

(63) Continuation of application No. 15/230,763, filed on Aug. 8, 2016, now Pat. No. 9,789,692.

(30) Foreign Application Priority Data

Sep. 7, 2015 (JP) ..... 2015-176005

(51) Int. Cl.
*B41J 2/165* (2006.01)

(52) U.S. Cl.
CPC ..... *B41J 2/16535* (2013.01); *B41J 2/16544* (2013.01); *B41J 2/16552* (2013.01); (Continued)

(58) Field of Classification Search
CPC ..... B41J 2/16535; B41J 2/16544; B41J 2/16552; B41J 2/1655; B41J 2/16558
(Continued)

(56) References Cited

U.S. PATENT DOCUMENTS 5,037,016 A 8/1991 Wingerter
2002/0168206 A1* 11/2002 Smith ..... B41J 11/0085 400/120.08

(Continued)

FOREIGN PATENT DOCUMENTS

JP 06-127098 5/1994
JP 2005-205631 8/2005

(Continued)

OTHER PUBLICATIONS

Notice of Allowance issued in Application No. 15/230,763 dated Jun. 14, 2017.

(Continued)

*Primary Examiner* — Huan H Tran
*Assistant Examiner* — Alexander D Shenderov
(74) *Attorney, Agent, or Firm* — Workman Nydegger

(57) ABSTRACT

A liquid ejecting apparatus includes a liquid ejecting head which ejects liquid from a nozzle that is disposed on a nozzle surface, a wiping member with a lengthwise shape that is able to contact the nozzle surface, a contact portion which is able to contact the opposite side from a side at which the wiping member contacts the nozzle surface, and a transport mechanism which transports the wiping member, in which the contact portion has a first contact portion which is separated from the wiping member when the wiping member is transported by the transport mechanism and which contacts the wiping member when the wiping member is caused to contact the nozzle surface, and a second contact portion which contacts the wiping member when the wiping member is transported by the transport mechanism.

16 Claims, 5 Drawing Sheets

(52) U.S. Cl.
CPC ..... *B41J 2002/1655* (2013.01); *B41J 2002/16558* (2013.01)

(58) Field of Classification Search
USPC ..... 347/33
See application file for complete search history.

(56) References Cited

U.S. PATENT DOCUMENTS

| | | | | |
|---|---|---|---|---|
| 2004/0218002 | A1* | 11/2004 | Nakamura | B41J 2/16535 347/33 |
| 2005/0156995 | A1 | 7/2005 | Nishino | |
| 2011/0234696 | A1 | 9/2011 | Inoue | |
| 2012/0218346 | A1* | 8/2012 | Inoue | B41J 2/16552 347/33 |
| 2013/0222476 | A1* | 8/2013 | Inoue | B41J 2/16535 347/33 |
| 2014/0035996 | A1* | 2/2014 | Gros Gras | B41J 2/1652 347/33 |
| 2014/0055523 | A1 | 2/2014 | Ozaki et al. | |
| 2014/0125734 | A1 | 5/2014 | Kobayashi | |
| 2014/0218440 | A1* | 8/2014 | Komatsu | B41J 2/16585 347/33 |

FOREIGN PATENT DOCUMENTS

| | | |
|---|---|---|
| JP | 2006-248102 | 9/2006 |
| JP | 2010-207728 | 9/2010 |
| JP | 2012-051132 | 3/2012 |
| JP | 2014-040036 | 3/2014 |
| JP | 2014-091319 | 5/2014 |

OTHER PUBLICATIONS

Office Action issued in U.S. Appl. No. 15/230,763 dated Feb. 9, 2017.

* cited by examiner

LIQUID EJECTING APPARATUS AND CLEANING DEVICE

CROSS REFERENCES TO RELATED APPLICATIONS

This application is a continuation of U.S. application Ser. No. 15/230,763, filed Aug. 8, 2016, which claims priority to Japanese Application No. 2015-176005, filed Sep. 7, 2015, the entireties of which are incorporated by reference herein.

BACKGROUND

1. Technical Field

The present invention relates to a liquid ejecting apparatus such as an ink jet printer, and a cleaning device.

2. Related Art

From the related art, as a type of liquid ejecting apparatus, an ink jet printer is known which performs printing by ejecting ink form a nozzle, which is formed on a nozzle surface of an ink jet head, onto a paper sheet. In such a printer, a head cleaning device is provided which cleans the nozzle surface by wiping the nozzle surface with a web (for example, refer to JP-A-2014-40036).

Such a head cleaning device is provided with a feeding shaft which feeds the web with a lengthwise belt shape that is wound in a roll shape, a winding shaft which winds the web which is fed from the feeding shaft, and an elastic body roller which is disposed between the feeding shaft and the winding shaft and presses the web on the nozzle surface. The elastic body roller is provided with a core portion which is formed in a rigid body such as metal, and an elastic body portion which covers the core portion and is formed by an elastic material such as a sponge or silicon rubber.

Then, in a state in which the head cleaning device is moved to a wiping position at which it is possible for the elastic body portion of the elastic body roller to press a web on the nozzle surface of the ink jet head, the nozzle surface is wiped by the web due to pressing on the nozzle surface by the elastic body portion due to the ink jet head being moved so as to pass above the head cleaning device. A part of the web which is fouled due to wiping is moved further to the downstream side than the elastic body roller due to a winding operation of the web using the winding shaft, and a clean part of the web is disposed on the elastic body roller.

However, in the head cleaning device of the printer described above, there is a problem in that the elastic body portion tends to be worn and deteriorate due to friction between the elastic body portion of the elastic body roller and the web due to the winding operation of the web of the winding shaft.

Note that, such a problem is not limited to an ink jet printer which performs printing by ejecting ink from the nozzle that is formed on the nozzle surface, and is generally common in a liquid ejecting apparatus which is provided with a head cleaning device that wipes while pressing the web on the nozzle surface using the elastic body.

An advantage of some aspects of the invention is to provide a liquid ejecting apparatus and a cleaning device in which it is possible to suppress wear to a contact portion due to friction with a wiping member.

SUMMARY

Hereinafter, means of the invention and operation effects thereof will be described.

According to an aspect of the invention, there is provided a liquid ejecting apparatus including a liquid ejecting head which ejects liquid from a nozzle that is disposed on a nozzle surface, a wiping member with a lengthwise shape that is able to wipe away the liquid that is adhered to the nozzle surface by contacting the nozzle surface, a contact portion which is able to contact the opposite side from a side at which the wiping member contacts the nozzle surface, a pressing mechanism which supports the contact portion and causes the wiping member to contact the nozzle surface by pressing in a direction in which the contact portion contacts the wiping member, and a transport mechanism which transports the wiping member, in which the contact portion has a first contact portion which is formed by an elastic material, is separated from the wiping member when the wiping member is transported by the transport mechanism, and which contacts the wiping member when the wiping member is caused to contact the nozzle surface, and a second contact portion which contacts the wiping member when the wiping member is transported by the transport mechanism.

According to this configuration, it is possible to suppress wear on the contact portion due to friction with the wiping member since the first contact portion which is formed by the elastic material is separated from the wiping member when the wiping member is transported by the transport mechanism.

In the liquid ejecting apparatus, it is preferable that the second contact portion has a smaller friction coefficient than the first contact portion.

According to this configuration, it is possible to transport the wiping member smoothly in comparison to a case where the first contact portion contacts the wiping member since the second contact portion contacts the wiping member when the wiping member is transported by the transport mechanism.

In the liquid ejecting apparatus, it is preferable that the pressing mechanism is disposed along the wiping member to be rotatable centered on an axis line which intersects with a transport direction of the wiping member, and a contact state of the contact portion and the wiping member is switched by rotating the pressing mechanism centered on the axis line.

According to this configuration, it is possible to switch the contact state of the contact portion and the wiping member by rotating the pressing mechanism.

In the liquid ejecting apparatus, it is preferable that the first contact portion is held in the pressing mechanism in a non-swinging state when the wiping member contacts the nozzle surface.

According to this configuration, it is possible to increase a degree of freedom of configuration design of the first contact portion since it is not necessary to set the first contact portion in a swingable shape (for example, a shape that has a rotatable curved surface and the like).

In the liquid ejecting apparatus, it is preferable that the first contact portion is provided with a linear portion which contacts the wiping member when the wiping member is caused to contact the nozzle surface.

According to this configuration, it is possible to improve trackability of the wiping member on the nozzle surface in comparison to a case where the first contact portion contacts the surface of the wiping member since the first contact portion is in line contact with the wiping member in the linear portion.

In the liquid ejecting apparatus, it is preferable that the second contact portion is disposed more on the upstream side than the first contact portion in a direction in which the wiping member is transported.

According to this configuration, it is possible to cause the wiping member to contact the first contact portion in a state of being adjusted by the second contact portion since the wiping member contacts the second contact portion prior to contacting the first contact portion.

According to another aspect of the invention, there is provided a cleaning device including a wiping member with a lengthwise shape that is able to wipe away liquid that is adhered to a nozzle surface by contacting the nozzle surface of a liquid ejecting head which ejects liquid from a nozzle that is disposed on a nozzle surface, a contact portion which is able to contact the opposite side from a side at which the wiping member contacts the nozzle surface, a pressing mechanism which supports the contact portion and causes the wiping member to contact the nozzle surface by pressing in a direction in which the contact portion contacts the wiping member, and a transport mechanism which transports the wiping member, in which the contact portion has a first contact portion which is formed by an elastic material, is separated from the wiping member when the wiping member is transported by the transport mechanism, and which contacts the wiping member when the wiping member is caused to contact the nozzle surface, and a second contact portion which contacts the wiping member when the wiping member is transported by the transport mechanism.

According to this configuration, it is possible to suppress wear on the contact portion due to friction with the wiping member since the first contact portion which is formed by the elastic material is separated from the wiping member when the wiping member is transported by the transport mechanism.

BRIEF DESCRIPTION OF THE DRAWINGS

The invention will be described with reference to the accompanying drawings, wherein like numbers reference like elements.

DESCRIPTION OF EXEMPLARY EMBODIMENTS

A first embodiment that embodies a liquid ejecting apparatus in an ink jet printer is described below with reference to the accompanying drawings.

Figure 1:
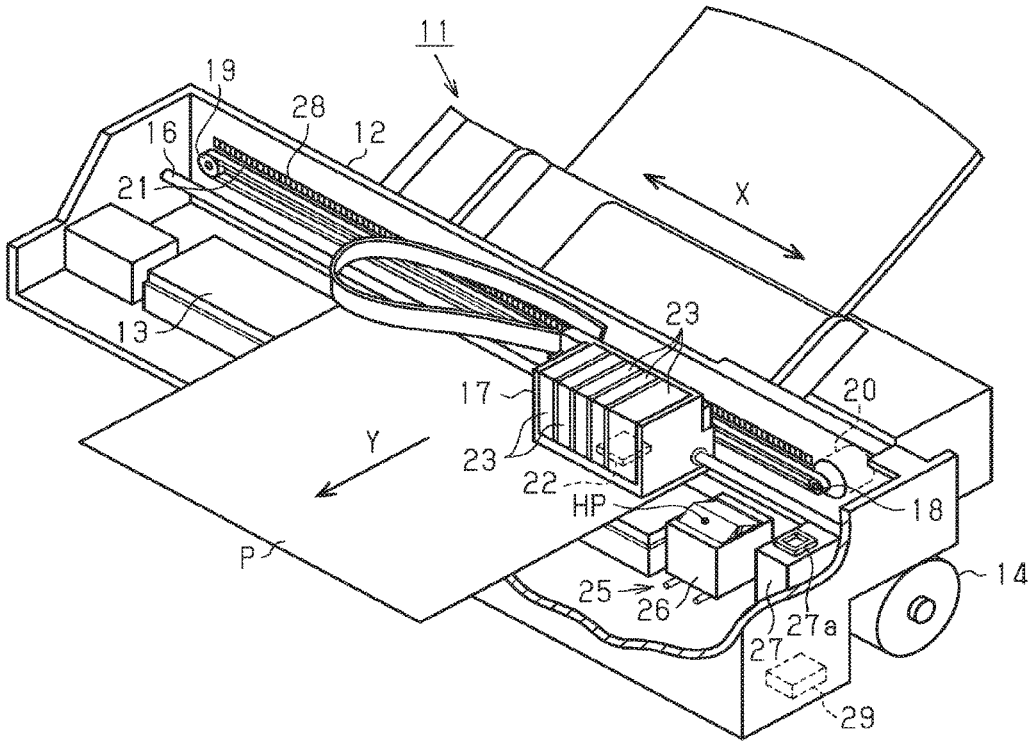
FIG. 1 is a perspective view of an ink jet printer of a first embodiment.

As shown in FIG. 1, an ink jet printer 11 as an example of the liquid ejecting apparatus is provided with a frame 12 with a substantially rectangular box shape where the upper surface is open. A support member 13 with a substantially square plate shape is provided on an inner bottom surface of the frame 12 so as to extend along a main scanning direction X (a left and right direction in FIG. 1). A recording medium P is transported along a sub-scanning direction Y (direction from the back toward the front in FIG. 1) which is orthogonal to the main scanning direction X on the support member 13 by a feeding roller (illustration omitted) and a pair of transport rollers (illustration omitted) being driven by power of a transport motor 14 that is provided on the lower portion on a reverse side of the frame 12.

A guide shaft 16 is erected above the support member 13 within the frame 12. A carriage 17 is supported on the guide shaft 16 in a state of being to reciprocally movable in the main scanning direction X. A driving pulley 18 and a driven pulley 19 are respectively rotatably provided at positions which correspond to both end portions of the guide shaft 16 on a rear surface within the frame 12. An output shaft of a carriage motor 20 that is a power source is connected to the driving pulley 18 when the carriage 17 is reciprocally moved.

One endless timing belt 21 is wound around the driving pulley 18 and the driven pulley 19, and a portion of the timing belt 21 is connected to the carriage 17. Accordingly, the carriage 17 is reciprocally moved in the main scanning direction X along the guide shaft 16 due to the timing belt 21 revolving around the driving pulley 18 and the driven pulley 19 in both forward and reverse directions due to power of the carriage motor 20.

A liquid ejecting head 22 is provided on the lower portion of the carriage 17. Meanwhile, a plurality of (five in the embodiment) ink cartridges 23 which retain ink as an example of liquid for supply to the liquid ejecting head 22 are mounted to be freely attached and detached on the carriage 17. Then, an image and the like is printed on the recording medium P by ejecting an ink droplet from the liquid ejecting head 22 on the recording medium P that is fed on the support member 13. The recording medium P to which the ink jet printer 11 of the embodiment is a printing target is, for example, paper, cloth, film, and the like. Note that, the ink jet printer 11 is also able to print on, for example, a towel, clothing (a shirt and the like), and the like.

Ink of different colors is respectively accommodated in a plurality (five) ink cartridges 23. For example, each color of ink of cyan (C), magenta (M), yellow (Y), black (K), and white (W) are accommodated in each ink cartridge 23. Color printing and the like on the recording medium P is performed by ejecting ink which is supplied from each ink cartridge 23 from the liquid ejecting head 22.

For example, in a case of a recoding medium P for a dark color, color printing is performed thereon after white printing (foundation printing) is performed. Note that, a mounting method of the ink cartridge 23 in the inkjet printer 11 is not limited to a so-called on-carriage type in which the ink cartridge 23 is mounted on the carriage 17, and may be a so-called off-carriage type in which the ink cartridge 23 is mounted to be freely attached and detached to a printer main body side cartridge holder.

In addition, as shown in FIG. 1, a maintenance unit 25 for performing maintenance on the liquid ejecting head 22 is provided on the lower side of a home position HP at which the carriage 17 is in standby during non-printing within the frame 12. The maintenance unit 25 is provided with a wiping device 26 as an example of the cleaning device which wipes the liquid ejecting head 22 and a capping device 27 which has a cap 27*a* that caps the liquid ejecting head 22.

The capping device 27 is provided with a suction pump (illustration omitted) which is driven when thickened ink and the like is suctioned and eliminated from a nozzle 38 (refer to FIG. 3) of the liquid ejecting head 22 by suctioning within the cap 27*a*. Then, the cap 27*a* is used as a discharge destination of the ink droplet when flushing is performed in which the liquid ejecting head 22 discharges the ink droplet unrelated to printing with the purpose of cleaning of the nozzle 38 (refer to FIG. 3).

As shown in FIG. 1, a linear encoder 28 which outputs pulses of a number which is proportional to an amount of movement of the carriage 17 is provided on a rear surface of the carriage 17 within the frame 12 so as to extend along the guide shaft 16. In addition, a controller 29 that governs printing control and maintenance control is provided in the ink jet printer 11. The controller 29 drives and controls the carriage motor 20 based on the output pulse of the linear encoder 28, and performs position control and a speed control of the carriage 17.

In addition, the controller 29 drives and controls the transport motor 14 and performs feeding and transport of the recording medium P. Furthermore, when the controller 29 determines that a condition for carrying out maintenance is established, after the carriage 17 is caused to move to a predetermined position on the home position HP side, at least one of the wiping device 26 and the capping device 27 is driven, and necessary maintenance out of wiping and cleaning of the liquid ejecting head 22 is performed.

Figure 2:
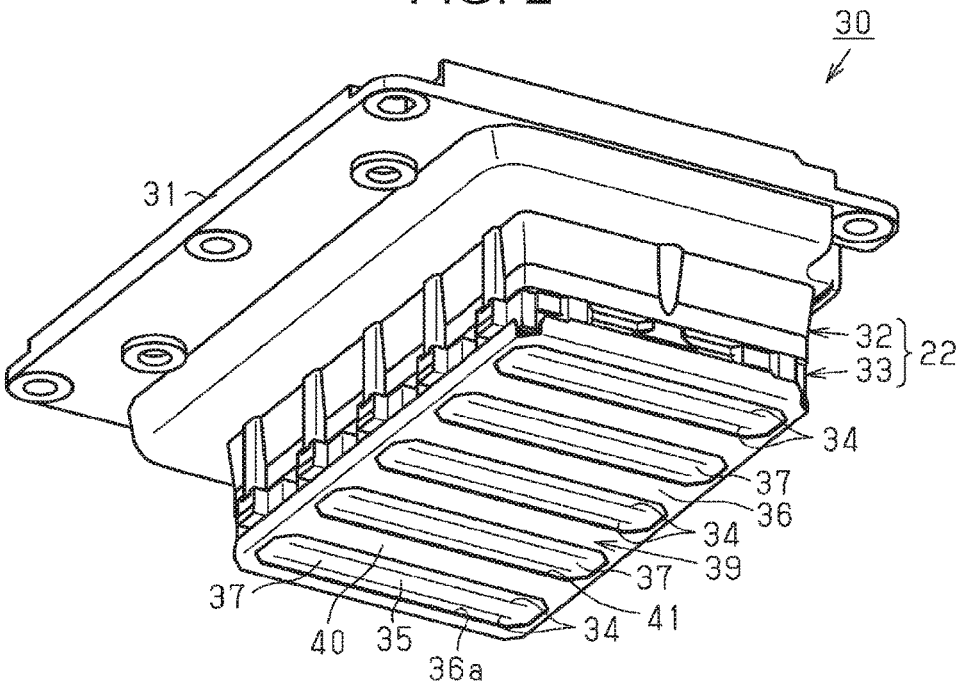
FIG. 2 is a perspective view of a head unit.

As shown in FIG. 2, since the head unit 30 is attached to a lower surface portion of the carriage 17, the head unit 30 is provided with a bracket portion 31 for attaching to the carriage 17 and the liquid ejecting head 22 with a rectangular cube shape which protrudes downward from the bracket portion 31. The liquid ejecting head 22 is provided with a flow path forming portion 32 with a rectangular cube shape which protrudes downward from the bracket portion 31 and a head main body 33 with a rectangular shape which is fixed to the lower side of the flow path forming portion 32. A plurality of rows (for example, 10 rows) of nozzle rows 34 are formed on the lower surface of the head main body 33 in FIG. 2.

In addition, a cover member 36 with a plate shape that has a plurality of (for example, five) through holes 36*a* is attached to the lower surface side of the head main body 33 so as to cover a part of a nozzle opening surface 35 (lower surface in the example) to which each nozzle 38 (refer to FIG. 3) that configures the nozzle row 34 is open. The plurality of nozzle rows 34 are exposed by a predetermined row number (for example, two rows) in one through hole 36*a*. In the example, a region which is exposed by the through hole 36*a* on the nozzle opening surface 35 is a nozzle peripheral region 37. The opening region of each nozzle 38 (refer to FIG. 3) is included in the nozzle peripheral region 37.

Figure 3:
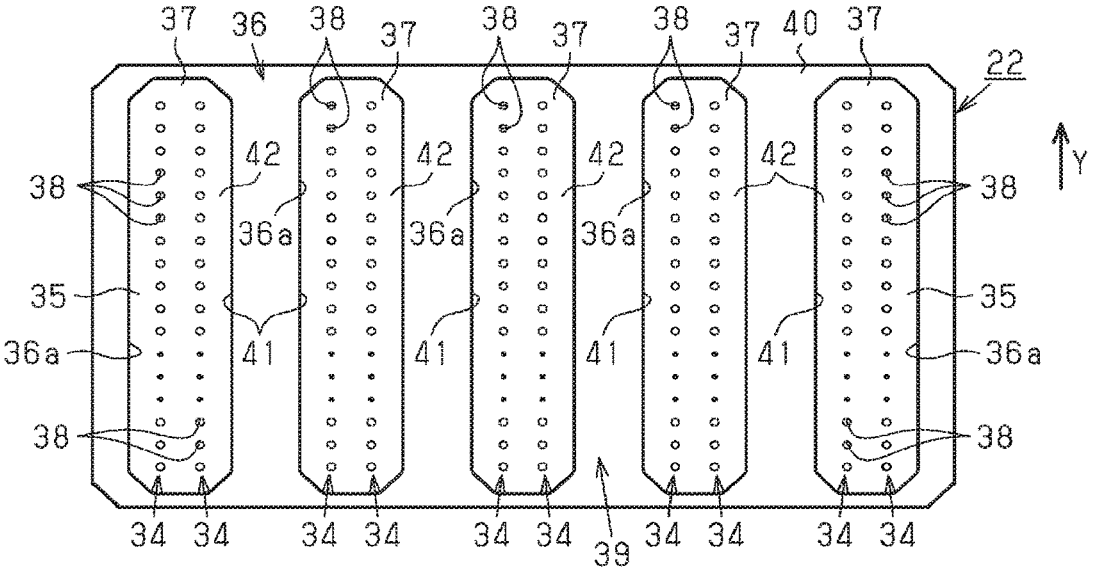
FIG. 3 is a bottom surface view of a head unit.
Figure 4:
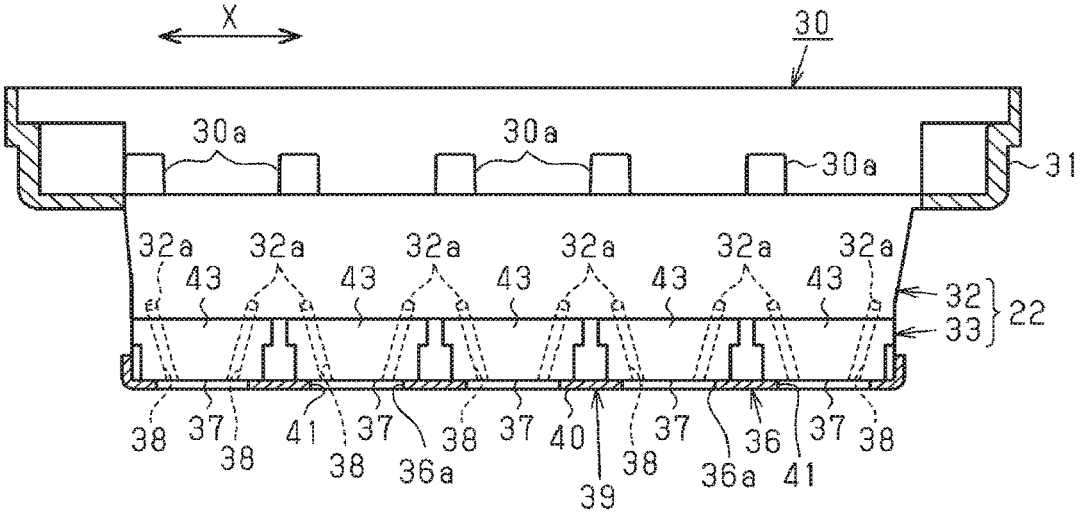
FIG. 4 is a sectional view of the head unit.

As shown in FIGS. 3 and 4, the cover member 36 is fixed to the liquid ejecting head 22 by a fixing structure such as a lock in a state in which the cover member 36 covers a part other than the nozzle peripheral region 37 which is exposed by the through hole 36*a* on the nozzle opening surface 35. Then, as shown in FIG. 3, the entire bottom surface of the liquid ejecting head 22 is a nozzle surface 39 that is a wiping target of the wiping device 26. The nozzle surface 39 is provided with the nozzle peripheral region 37 (that is, a region within the through hole 36*a*), and a protrusion surface 40 which is a non-nozzle region that is a region other than the nozzle peripheral region 37 and protrudes more than the nozzle peripheral region 37 by only a thickness of the cover member 36.

Accordingly, a step 41 is present between the nozzle peripheral region 37 and the protrusion surface 40 (non-nozzle peripheral region). That is, the nozzle surface 39 is configured by an uneven surface which is a concave portion at a part of the nozzle peripheral region 37 and a convex portion at a part of the protrusion surface 40. Note that, the cover member 36 is configured by, for example, metal (for example, stainless steel or the like) and the like.

As shown in FIG. 3, the nozzle row 34 is formed of multiple (for example, 180 or 360) nozzles 38 which are disposed at a constant pitch along the sub-scanning direction Y. Each nozzle row 34 respectively ejects ink of one color which corresponds to the ink color of the ink cartridge 23 (refer to FIG. 1). Of course, ink of a color other than the four colors of CMYK, and white (W) may be ejected, and for example, ink of a color such as light magenta, light cyan, light yellow, gray, and orange may be ejected. In addition, the color number of the liquid ejecting head 22 may be four colors of CMYK, three colors of CMY, one color of black, and the like. Furthermore, there may be unused nozzle rows which do not eject ink within the plurality of nozzle rows 34.

In addition, a liquid repelling treatment in which ink is easily repelled (ink repellent treatment) is carried out on the nozzle opening surface 35 and a liquid repellent film 42 (ink repellent film) is deposited on the front surface of the nozzle opening surface 35. Ink that is used in the embodiment is, for example, pigment ink. In the pigment ink, particles of multiple pigments are dispersed within the liquid that is used as a dispersion medium. Organic pigments with an average particle diameter of approximately 100 nm as the pigments of cyan, magenta, and yellow, carbon black (inorganic pigments) with average particle diameter of approximately 120 nm as the black pigment, titanium oxide (inorganic pigments) with average particle diameter of approximately 320 nm as the white pigment, and the like may be used.

Ink in the present example is water-based ink, and particles of multiple pigments are dispersed within water that is the dispersion medium. For this reason, in the present example, the liquid repellent film 42 is a water repellent film having a function to repel water-based ink. The liquid repellent film may be configured from a thin film under layer that has, for example, a polyorganosiloxane containing an alkyl group as a main material and a liquid repellent film layer that is formed of a metal alkoxide that has a long-chain polymer group containing fluorine. The liquid repellent film 42 is gradually worn due to wiping with respect to the nozzle opening surface 35 being repeatedly performed, and when the liquid repellent film 42 is worn by a certain amount or more, liquid repellence is lowered. Note that, the liquid repellent film 42 may be a liquid-repellent coating film and may be a monomolecular film with liquid repellence, and it is possible to arbitrarily select the film thickness and liquid repellent treatment method thereof.

In as state in which liquid repellence of the liquid repellent film 42 is lowered, a wetting angle (contact angle) of liquid such as ink mist is reduced in the nozzle peripheral region 37. For this reason, a plurality of ink mists which are adhered in the nozzle peripheral region 37 tend to spread and one ink droplet (adhered ink) develops relatively widely. For this reason, there is a concern that such adhered ink is present in the vicinity of the nozzle 38, an opening of a part of the nozzles 38 is blocked, and furthermore, flows within the nozzle 38.

In addition, when the ink droplet is ejected from the nozzle 38 in a state in which the adhered ink is present in the vicinity of the nozzle 38, the ejected ink droplet contacts the adhered ink, and curved flight of the ink droplet is caused.

Such curved flight of the ink droplet leads to lowering of printing quality caused by deviation of a landing position (that is, printing dot formation position) of the ink droplet on the recording medium P from an assumed position. As a result, it is necessary to suppress as much as possible wear on the liquid repellent film 42 due to wiping.

Meanwhile, the cover member 36 is manufactured such that a metal plate is processed in a predetermined shape, and liquid repellent treatment is not carried out on the front surface of the cover member 36. For this reason, the protrusion surface 40 has a lower liquid repellence than the nozzle peripheral region 37. That is, a wetting angle of ink with respect to the protrusion surface 40 is smaller than a wetting angle of ink with respect to the nozzle peripheral region 37.

As shown in FIG. 4, the liquid ejecting head 22 has a plurality of (for example five in the embodiment) recording heads 43 (unit heads) that are arranged in parallel at a constant pitch in the main scanning direction X. A peripheral edge portion of the nozzle opening surface 35 which is the lower surface of the recording head 43 is covered by the cover member 36, and the nozzle peripheral region 37 which includes two rows of nozzles 38 is exposed from the through hole 36*a* that is bored in the cover member 36.

Each nozzle 38 is linked to each ink flow path 32*a* which passes within the flow path forming portion 32, and each ink flow path 32*a* is linked to a plurality of supply pipe portions 30*a* which protrude upward from the upper surface of the flow path forming portion 32 through which a flow path that is not illustrated passes. Each supply pipe portion 30*a* is connected to a supply opening of each ink cartridge 23 (refer to FIG. 1) that is mounted on the carriage 17 via the flow path that is not illustrated. Accordingly, from each ink cartridge 23 (refer to FIG. 1), ink of each corresponding color is supplied to the nozzle 38 of the corresponding recording head 43 through each supply pipe portion 30*a*, each ink flow path 32*a*, and the like.

Note that, in a case of the off-carriage type, each supply pipe portion 30*a* is connected via a tube and supply opening of each ink cartridge (illustration omitted) which is mounted on the cartridge holder (illustration omitted) on the printer main body side. In addition, the liquid ejecting head 22 may be configured from one head which has a nozzle row of three or more rows.

Next, the configuration of the wiping device 26 will be described in detail.

Figure 5:
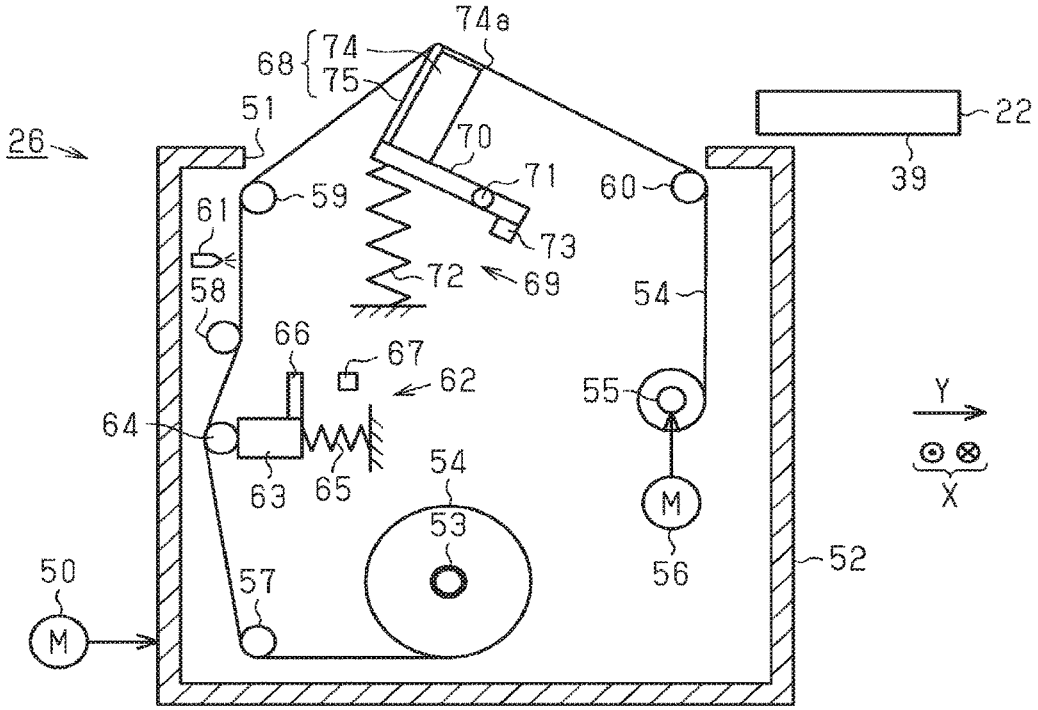
FIG. 5 is a sectional schematic view illustrating a state prior to a nozzle surface being wiped by a wiping device.

As shown in FIG. 5, the wiping device 26 is reciprocally moved along the sub-scanning direction Y via, for example, a rack and pinion mechanism, a ball screw mechanism, or the like (illustration omitted) by driving of the wiping motor 50 and is provided with a case 52 with a bottomed rectangular box shape that has an opening portion 51 on the upper end. The wiping motor 50 is driven and controlled using the controller 29 (refer to FIG. 1). A feeding shaft 53 which extends in the main scanning direction X is disposed to be rotatable at the center of a bottom portion within the case 52. A wiping member 54 which is configured by a cloth with a lengthwise belt shape is supported on the feeding shaft 53 in a state of being wound in a roll shape.

In the wiping member 54, a width in the main scanning direction X is substantially the same as the nozzle surface 39 of the liquid ejecting head 22, and the wiping member 54 wipes ink which is adhered (adhered ink) to the nozzle surface 39 by contacting the nozzle surface 39. The winding shaft 55 that is able to wind the wiping member 54 is disposed obliquely above the sub-scanning direction Y side of the feeding shaft 53 within the case 52 so as to extend parallel to the feeding shaft 53. The winding shaft 55 is configured to be rotatable, and winds the wiping member 54 by rotatably driving using a winding motor 56. The winding motor 56 is driven and controlled using the controller 29 (refer to FIG. 1).

A first roller 57, a second roller 58, a third roller 59, and a fourth roller 60 are disposed within the case 52 so as to extend parallel to the feeding shaft 53 in order to lead the wiping member 54 that is fed from the feeding shaft 53 to the winding shaft 55 along a transport path. The first roller 57, the second roller 58, the third roller 59, and the fourth roller 60 are disposed placed at sequential intervals from the feeding shaft 53 side that is the upstream side toward the winding shaft 55 which is the downstream side along the transport path of the wiping member 54, and are respectively disposed to be rotatable.

The third roller 59 is disposed in the vicinity of the end portion on the opposite side to the sub-scanning direction Y in the opening portion 51, and the fourth roller 60 is disposed in the vicinity of the end portion on the sub-scanning direction Y side in the opening portion 51. The second roller 58 is disposed on the lower side of the third roller 59, and the first roller 57 is disposed on the lower side of the second roller 58. The feeding shaft 53 is disposed so as to be adjacent to the sub-scanning direction Y side of the first roller 57. The winding shaft 55 is disposed on the lower side of the fourth roller 60.

The first roller 57, the third roller 59, and the fourth roller 60 contact the surface on the opposite side from the side that contacts the nozzle surface 39 in the wiping member 54, and the second roller 58 contacts the surface on the side that contacts the nozzle surface 39 in the wiping member 54. Then, when the winding shaft 55 is rotatably driven by the winding motor 56, the wiping member 54 is wound by the winding shaft 55, the wiping member 54 which is fed from the feeding shaft 53 is transported to the winding shaft 55 while being guided by each roller 57 to 60 along the transport path. Accordingly, in the embodiment, the transport mechanism which transports the wiping member 54 is configured by each roller 57 to 60, the winding shaft 55, and the winding motor 56. In addition, a cleaning liquid ejecting portion 61, which ejects and coats (moistens) cleaning liquid (for example, water and the like) on the surface on the side contacting the nozzle surface 39 in the wiping member 54 that is positioned between the second roller 58 and the third roller 59, is disposed within the case 52.

Furthermore, a portion on the surface on the opposite side from the side which contacts the nozzle surface 39 in the wiping member 54 between the first roller 57 and the second roller 58 contacts within the case 52, and a detection mechanism 62, which detects that the wiping member 54 that is supported in a state of being wound on the feeding shaft 53 is no longer present, is disposed within the case 52.

The detection mechanism 62 is provided with a main body portion 63, a pressing roller 64 that is provided to be rotatable on the wiping member 54 side in the main body portion 63, and a spring 65 that is provided on the opposite side from the wiping member 54 side in the main body portion 63 and biases the main body portion 63 toward the wiping member 54 side. Furthermore, the detection mechanism 62 is provided with a flag portion 66 that is provided on the upper side of the main body portion 63 and a contact sensor 67 that is separated from the flag portion 66 and is disposed on the sub-scanning direction Y side. The contact sensor 67 is electrically connected to the controller 29 (refer to FIG. 1), and a detection signal is transmitted to the controller 29 when the contact sensor 67 contacts the flag portion 66.

In addition, a contact portion 68, which is able to contact the surface on the opposite side from the side at which the nozzle surface 39 contacts in the wiping member 54 that is positioned between the third roller 59 and the fourth roller 60, is disposed within the case 52. In the contact portion 68, the width in the main scanning direction X is substantially the same as the wiping member 54, and the contact portion 68 is supported by a pressing mechanism 69 which contacts the wiping member 54 on the nozzle surface 39 by pressing in a direction in which the contact portion 68 contacts the wiping member 54.

The pressing mechanism 69 is provided with a support plate 70 with a rectangular shape which is disposed along the wiping member 54 and which supports the contact portion 68 at the end portion on the upstream side of the transport path of the wiping member 54 on the upper surface, and a support axis 71 which supports the support plate 70 to freely rotate at a position from the end portion on the downstream side of the transport path of the wiping member 54 than the center portion while extending in the main scanning direction X. That is, the support plate 70 is rotatable centered on an axis line of the support axis 71 which extends in the main scanning direction X that is orthogonal to (intersects with) the transport direction of the wiping member 54.

Furthermore, the pressing mechanism 69 is provided with a pressing spring 72 that biases an end portion on the upstream side of the transport path of the wiping member 54 on a lower surface of the support plate 70 toward the upper surface which is the wiping member 54 side, and a stopper 73 in which an end portion on the downstream side of the transport path of the wiping member 54 on the lower surface of the support plate 70 contacts and which restricts to a rotation range with the support axis 71 of the support plate 70 as the center of rotation due to biasing force of the pressing spring 72.

The contact portion 68 is provided with a first contact portion 74 with a rectangular cube shape that is configured by an elastic material such as rubber and a second contact portion 75 with a rectangular plate shape that is configured by a hard material such as a metal. Accordingly, the second contact portion 75 has a smaller friction coefficient than the first contact portion 74. The second contact portion 75 is disposed so as to be adjacent to the first contact portion 74 on the upper surface of the support plate 70 and the height from the upper surface of the support plate 70 is slightly higher than the first contact portion 74. In this case, the second contact portion 75 is disposed more on the upstream side than the first contact portion 74 in a direction in which the wiping member 54 is transported.

The first contact portion 74 with a rectangular cube shape is provided with four sides extending in a straight line shape along the main scanning direction X, and out of the four sides, one side that is not adjacent to the support plate 70 or the second contact portion 75 is set as a linear portion 74*a*. Then, a corner portion which includes the linear portion 74*a* in the first contact portion 74 is angular.

Note that, as shown in FIG. 5, ordinarily, since the contact portion 68 is pressed on the wiping member 54 side which is positioned between the third roller 59 and the fourth roller 60 by the pressing mechanism 69, in a standby state (state shown in FIG. 5) of the wiping device 26, the majority of the contact portion 68 protrudes out of the case 52 from the opening portion 51 along with the wiping member 54 which is positioned between the third roller 59 and the fourth roller 60. In this case, the first contact portion 74 does not contact the wiping member 54, but the second contact portion 75 contacts the wiping member 54.

Next, an action when wiping the nozzle surface 39 of the liquid ejecting head 22 using the wiping device 26 will be described.

Then, in a case where the nozzle surface 39 of the liquid ejecting head 22 is wiped by the wiping device 26, first, the carriage 17 is moved to the home position HP, as shown in FIG. 5, the position of the liquid ejecting head 22 is matched to the position of the wiping device 26 in the main scanning direction X. At this time, the liquid ejecting head 22 faces the wiping member 54 which protrudes from the opening portion 51 of the case 52 in the sub-scanning direction Y.

Figure 6:
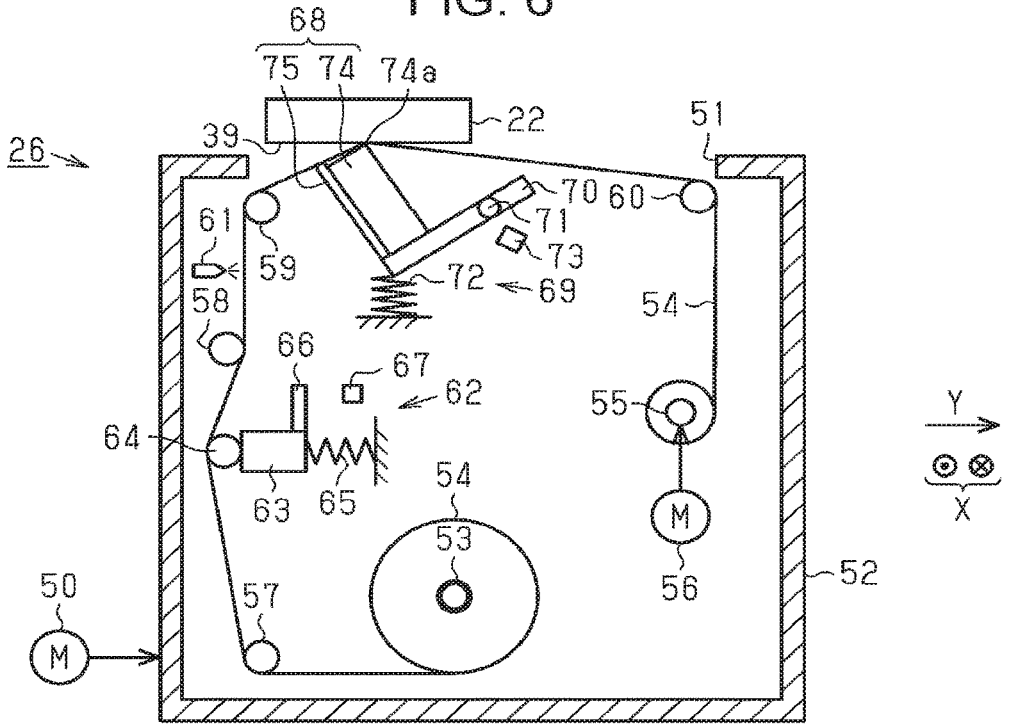
FIG. 6 is a sectional schematic view illustrating a state when the nozzle surface is wiped by the wiping device.

Next, the wiping device 26 is moved toward the liquid ejecting head 22 side along the sub-scanning direction Y. By doing this, as shown in FIG. 6, the contact portion 68 across the wiping member 54 is pressed down against the biasing force of the pressing spring 72 by the liquid ejecting head 22, and the support plate 70 is rotated in a counterclockwise direction in FIG. 6 with the support axis 71 as the rotation center. Thereby, the majority of the contact portion 68 is in a state of being accommodated within the case 52.

In this state, a part which corresponds to the linear portion 74*a* of the first contact portion 74 in the wiping member 54 presses the linear portion 74*a* and contacts the nozzle surface 39 of the liquid ejecting head 22 That is, the linear portion 74*a* (first contact portion 74) contacts the wiping member 54 when the wiping member 54 is caused to contact the nozzle surface 39. At this time, the pressing mechanism 69 is held in a state in which the first contact portion 74 and the second contact portion 75 do not swing, and contacts the second contact portion 75 and the wiping member 54.

Next, when the wiping device 26 is moved in the sub-scanning direction Y, the nozzle surface 39 is sequentially wiped by a part which is pressed by the linear portion 74*a* in the wiping member 54. Then, as shown in FIG. 7, when the opening portion 51 of the case 52 of the wiping device 26 is moved more to the sub-scanning direction Y side than the liquid ejecting head 22, the wiping of the nozzle surface 39 is completed by the wiping member 54.

Figure 7:
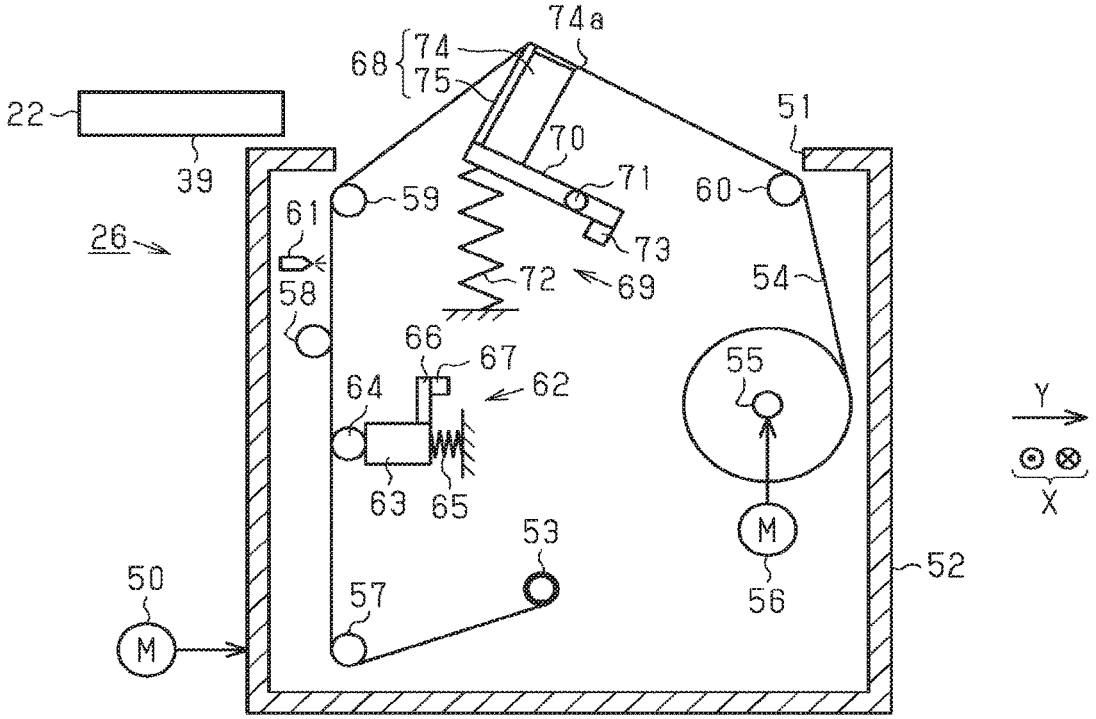
FIG. 7 is a sectional schematic view illustrating a state after the nozzle surface is wiped by the wiping device.

At this time, since the pressing state of the contact portion 68 across the wiping member 54 by the liquid ejecting head 22 is released, the end portion on the contact portion 68 side on the support plate 70 is pressed up by the biasing force of the pressing spring 72 and the support plate 70 is rotated in a clockwise direction in FIG. 7 with the support axis 71 as the rotation center. Thereby, the contact portion 68 returns to an original position that is a position when the wiping device 26 is in the standby state (state shown in FIG. 5). At this time, the second contact portion 75 contacts the wiping member 54, but the first contact portion 74 is separated from the wiping member 54.

In this manner, on the support plate 70, an angle position is changed when the nozzle surface 39 of the liquid ejecting head 22 is wiped by the wiping member 54, and when the nozzle surface 39 of the liquid ejecting head 22 is not wiped by the wiping member 54. Then, the contact state between the contact portion 68 and the wiping member 54 changes due to the angle position of the support plate 70 being changed. Accordingly, the contact state between the contact portion 68 and the wiping member 54 are switched due to the support plate 70 being rotated with the support axis 71 as the rotation center.

Then, after wiping of the nozzle surface 39 is completed by the wiping member 54, the carriage 17 is moved above the support member 13 and performs printing on the recording medium P. After that, the wiping device 26 is in the standby state (state shown in FIG. 5) moved in a direction opposite from the sub-scanning direction Y. Then, in a case where the nozzle surface 39 of the liquid ejecting head 22 is wiped again using the wiping device 26, first, the wiping member 54 is wound at a predetermined amount by the winding shaft 55.

By doing this, a part fouled by ink which corresponds to the first contact portion 74 on the wiping member 54 is transported further to the downstream side than the first contact portion 74 due to cleaning of the nozzle surface 39 by the wiping member 54 of the previous time. At this time, in the contact portion 68, in a state in which the first contact portion 74 has a larger friction coefficient than the second contact portion 75 is separated from the wiping member 54, only the second contact portion 75 that has a smaller friction coefficient than the first contact portion 74 contacts the wiping member 54. For this reason, a load applied to a winding motor 56 is reduced when the wiping member 54 is wound by a predetermined amount by the winding shaft 55.

Furthermore, at this time, further on the upstream side than the contact portion 68, cleaning liquid is ejected from the cleaning liquid ejecting portion 61 that is to improve a wiping property with respect to the nozzle surface 39 of the wiping member 54 and is coated on the surface on the side that contacts the nozzle surface 39 on the wiping member 54. For this reason, the cleaning liquid that is coated in surplus is squeezed out in a process in which the wiping member 54 on which the cleaning liquid is coated contacts the second contact portion 75 during transport. Accordingly, the coating state of the cleaning liquid becomes uniform in a part further on the downstream side than the second contact portion 75 on the wiping member 54.

Furthermore, at this time, the wiping member 54 scrapes away foreign matter such as dust that is adhered to the surface on the opposite side from the side that contacts the nozzle surface 39 (surface on the side that contacts the first contact portion 74) in a process in which the wiping member 54 contacts the second contact portion 75 during transport. For this reason, since performance of wiping of the nozzle surface 39 is suppressed in a state in which the foreign matter is interposed between the first contact portion 74 and the wiping member 54, risk of damage being applied to the nozzle surface 39 is reduced.

After that, in the same manner as described above, wiping of the nozzle surface 39 of the liquid ejecting head 22 is performed by the wiping member 54 of the wiping device 26. Then, the wiping member 54 is wound using the winding shaft 55, and as shown in FIG. 7, in a case where the wiping member 54 that is supported on the feeding shaft 53 is not present, a tensile load which acts on the wiping member 54 is increased. By doing this, the wiping member 54, which is curved by being pressed by the pressing roller 64 between the first roller 57 and the second roller 58, is a straight line shape between the first roller 57 and the second roller 58.

Thereby, since the wiping member 54 presses the main body portion 63 against the biasing force of the spring 65 of the detection mechanism 62 via the pressing roller 64, the main body portion 63 is moved in the sub-scanning direction Y which is a direction in which the spring 65 is contracted, and the flag portion 66 contacts the contact sensor 67. Due to contact with the contact sensor 67 of the flag portion 66, the detection signal is transferred from the contact sensor 67 to the controller 29 (refer to FIG. 1), and the controller 29 ascertains that the wiping member 54 that is supported in a state of being wound on the feeding shaft 53 is not present. After that, the controller 29 notifies to a user that the wiping member 54 is spent to a notification portion that is not illustrated.

In addition, even in a case where it is detected by the detection mechanism 62 that the wiping member 54 that is supported in a state of being wound on the feeding shaft 53 is not present, since a part that is curved due to pressing by the pressing roller 64 between the first roller 57 and the second roller 58 on the wiping member 54 is transported by the wiping member 54, it is possible to perform wiping of one cycle of the nozzle surface 39 by the wiping member 54.

In addition, pressing force from the wiping member 54 acts on the support plate 70 via the second contact portion 75 during transport of the wiping member 54, but the pressing force acts in a direction in which the support plate 70 is rotated in a clockwise direction in FIG. 7. In this case, since the support plate 70 abuts with the stopper 73, the support plate 70 is not rotated in the clockwise direction in FIG. 7. Accordingly, since the support plate 70 is not rotated, the second contact portion 75 also does not move. As a result, it is possible to detect with good precision that the wiping member 54 that is supported in a state of being wound on the feeding shaft 53 is not present by the detection mechanism 62.

According to the embodiment described above, it is possible to obtain the effects indicated below.

(1) The contact portion 68 is formed by the elastic material, is separated from the wiping member 54 when the wiping member 54 is transported, and has the first contact portion 74 which contacts the wiping member 54 when the wiping member 54 contacts the nozzle surface 39 and the second contact portion 75 which contacts the wiping member 54 when the wiping member 54 is transported. For this reason, when the wiping member 54 is transported, it is possible to suppress wear on the first contact portion 74 (contact portion 68) due to friction with the wiping member 54 since the first contact portion 74 which is formed by the elastic material such as rubber that is easily worn in comparison to a hard material such as a metal is separated from the wiping member 54.

(2) The second contact portion 75 has a smaller friction coefficient than the first contact portion 74. For this reason, when the wiping member 54 is transported, it is possible to transport the wiping member 54 smoothly in comparison to a case where the first contact portion 74 contacts the wiping member 54 since the second contact portion 75 contacts the wiping member 54.

(3) The contact state between the contact portion 68 and the wiping member 54 is switched by rotating the support plate 70 (pressing mechanism 69) centered on the axis line of the support axis 71 which is orthogonal to (intersects with) the transport direction of the wiping member 54. For this reason, it is possible to easily switch the contact state of the contact portion 68 and the wiping member 54 by rotating the support plate 70 (pressing mechanism 69).

(4) The first contact portion 74 is held in the pressing mechanism 69 in a non-swinging state when the wiping member 54 contacts the nozzle surface 39. For this reason, it is possible to increase a degree of freedom of configuration design of the first contact portion 74 since it is not necessary to set the first contact portion 74 in a swingable shape (for example, a shape that has a rotatable curved surface or the like).

(5) The first contact portion 74 is provided with the linear portion 74*a* that contacts the wiping member 54 when the wiping member 54 is caused to contact the nozzle surface 39. For this reason, it is possible to improve trackability on the nozzle surface 39 of the wiping member 54 in comparison to a case where the first contact portion 74 contacts the surface of the wiping member 54 since the first contact portion 74 is in line contact with the wiping member 54 in the linear portion 74*a*. Accordingly, it is possible to suitably wipe the nozzle surface 39 which is configured by an uneven surface using the wiping member 54.

(6) The second contact portion 75 is disposed further on the upstream side than the first contact portion 74 in a direction in which the wiping member 54 is transported. For this reason, it is possible to cause the wiping member 54 to contact the first contact portion 74 in a state of being adjusted by the second contact portion 75 since the wiping member 54 contacts the second contact portion 75 prior to contacting the first contact portion 74. That is, it is possible to cause the wiping member 54 to contact the first contact portion 74 in a state in which adjustment of the amount of cleaning liquid that is applied to the wiping member 54 or removal of the foreign matter that is adhered to the wiping member 54 is performed by the second contact portion 75.

Modification Examples

Note that, the embodiments may be modified as below.

Figure 8:
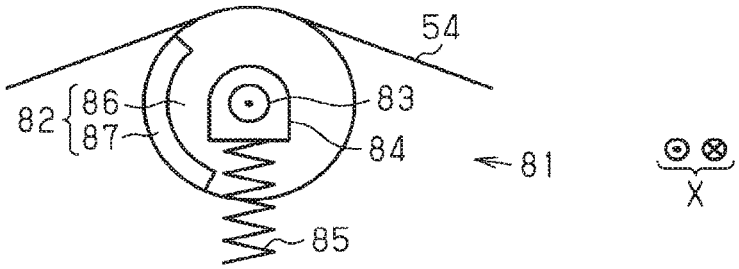
FIG. 8 is a schematic view illustrating a pressing mechanism of a modification example.
Figure 9:
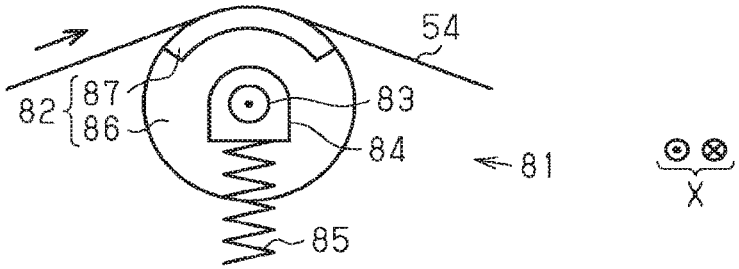
FIG. 9 is a schematic view illustrating a pressing mechanism of a modification example.

As shown in FIG. 8, the pressing mechanism 69 may be modified to a pressing mechanism 81. That is, the pressing mechanism 81 is provided with a contact portion 82 with a cylindrical shape, a shaft member 83 which extends in the main scanning direction X that is integrally formed in the center of the contact portion 82, a bearing portion 84 which supports the shaft member 83 to be rotatable, and a pressing spring 85 which causes the contact portion 82 to contact the wiping member 54 by biasing the contact portion 82 via the bearing portion 84 and the shaft member 83. The contact portion 82 is provided with a first contact portion 86 with a substantially cylindrical shape that is made from an elastic material such as rubber, and a second contact portion 87 with a plate shape that is an arc-shape viewed from the main scanning direction X made from a hard material such as metal or a synthetic resin that is provided in a portion in a peripheral direction on the front surface of the first contact portion 86. The second contact portion 87 has a smaller friction coefficient than the first contact portion 86, and the contact portion 82 is rotatably driven by a driving source (illustration omitted) such as a motor. Then, as shown in FIG. 8, in a case where the wiping member 54 is caused to contact the nozzle surface 39, out of the contact portion 82, only the first contact portion 86 contacts the wiping member 54, and as shown in FIG. 9, in a case where the wiping member 54 is transported, the contact portion 82 is rotatably driven such that out of the contact portion 82, only the second contact portion 87 contacts the wiping member 54.

Figure 10:
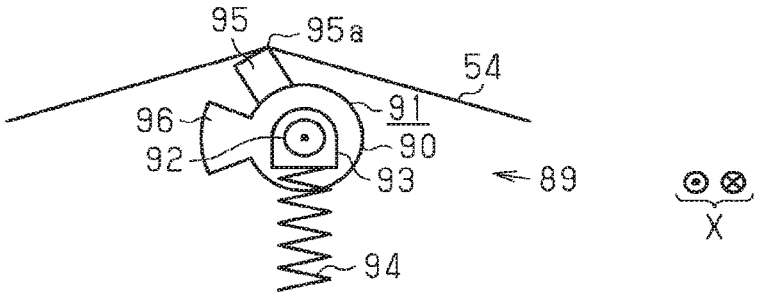
FIG. 10 is a schematic view illustrating a pressing mechanism of a modification example.

As shown in FIG. 10, the pressing mechanism 69 may be modified to a pressing mechanism 89. That is, the pressing mechanism 89 is provided with a contact portion 91 that has a main body portion 90 with a cylindrical shape, a shaft member 92 which extends in the main scanning direction X that is integrally formed in the center of the main body portion 90, a bearing portion 93 which supports the shaft member 92 to be rotatable, and a pressing spring 94 which causes the contact portion 91 to contact the wiping member 54 by biasing the contact portion 91 via the shaft member 92 and the bearing portion 93. The contact portion 91 is provided with a first contact portion 95 with a rectangular cube shape that is made from an elastic material such as rubber that is provided in a portion on a peripheral surface of the main body portion 90, and a second contact portion 96 with a block shape that is a fan shape viewed from the main scanning direction X made from a hard material such as metal or a synthetic resin that is integrally formed with the main body portion 90 so as to be adjacent to the first contact portion 95 in a portion on the peripheral surface of the main body portion 90. The second contact portion 96 has a smaller friction coefficient than the first contact portion 95, and the contact portion 91 is rotatably driven by a driving source (illustration omitted) such as a motor. Then, as shown in FIG. 10, in a case where the wiping member 54 is caused to contact the nozzle surface 39, out of the contact portion 91, only a corner portion 95*a* (linear portion) of the first contact portion 95 contacts the wiping member 54, and in a case where the wiping member 54 is transported, the contact portion 91 is rotatably driven such that out of the contact portion 91, only the second contact portion 96 contacts the wiping member 54.

Figure 11:
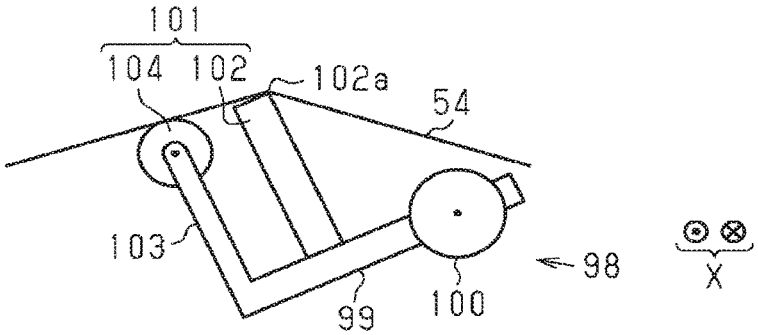
FIG. 11 is a schematic view illustrating a pressing mechanism of a modification example.

As shown in FIG. 11, the pressing mechanism 69 may be modified to a pressing mechanism 98. That is, the pressing mechanism 98 is provided with a support plate 99 with a rectangular plate shape which extends in the main scanning direction X, a shaft member 100 which extends along the main scanning direction X that is provided on one end side in a short direction of the support plate 99, and a contact portion 101 which is provided on the front surface on the other end side of the support plate 99. The contact portion 101 is provided with a first contact portion 102 with a rectangular cube shape that is made from an elastic material such as rubber, and a second contact portion 104 which is configured by a rotary roller made from a hard material such as a synthetic resin which extends in the main scanning direction X that is supported to be rotatable by an arm 103 that is erected so as to be adjacent to the first contact portion 102. The second contact portion 104 has a smaller friction coefficient than the first contact portion 95, and is disposed further on the upstream side in the transport direction of the wiping member 54 than the first contact portion 95. The support plate 99 rotates the shaft member 100 about a center of rotation accompanying rotation of the shaft member 100. The shaft member 100 is biased to the wiping member 54 side using a torsion coil spring (illustration omitted). Then, as shown in FIG. 11, in a case where the wiping member 54 is caused to contact the nozzle surface 39, out of the contact portion 101, only a corner portion 102*a* (linear portion) of the first contact portion 102 contacts the wiping member 54, and in a case where the wiping member 54 is transported, the support plate 99 is rotated such that out of the contact portion 101, only the second contact portion 104 contacts the wiping member 54. In this case, a rotation operation of the support plate 99 with the shaft member 100 as the center of rotation is performed due to biasing force of the torsion coil spring (illustration omitted) and biasing force from the nozzle surface 39 side against the biasing force. Note that, the shaft member 100 may be rotatably driven by a driving source (illustration omitted) such as a motor.

In the wiping device 26, a plurality of (for example, two) portions of the transport path of the wiping member 54 are overlapped up and down by the wiping member 54, and a plurality of parts of the wiping member 54 that overlap up and down may be configured so as to be caused to contact the nozzle surface 39 by the pressing mechanism 69 pressing the contact portion 68. By doing this, since a plurality of wiping members 54 contact the nozzle surface 39 in a state of overlapping, it is possible to improve trackability on the nozzle surface 39 of the wiping member 54. For this reason, it is possible to suitably wipe the nozzle surface 39 which is configured by an uneven surface using the wiping member 54. That is, it is possible to absorb a step 41 on the nozzle surface 39 by overlapping a plurality of wiping members 54.

That is, it is possible to effectively wipe a nozzle peripheral region 37 without the protrusion surface 40 on the nozzle surface 39 by overlapping a plurality of wiping members 54.

Flushing may be performed by discharging ink with the object of elimination and the like of clogging of the nozzle 38 unrelated to printing from the nozzle 38 of the liquid ejecting head 22 in a region in which the wiping member 54 is spent in the wiping device 26 (region in which the nozzle surface 39 is wiped).

The second contact portion 75 is not necessarily disposed further on the upstream side than the first contact portion 74 in a direction in which the wiping member 54 is transported.

The first contact portion 74 is not necessarily provided with the linear portion 74*a*. That is, for example, the first contact portion 74 may be a swingable shape (for example, a columnar shape, a cylindrical shape, or the like such as a roller that has a rotatable curved surface and the like).

The wiping device 26 is not necessarily configured so as to switch the contact state between the contact portion 68 and the wiping member 54 by rotating the support plate 70 (pressing mechanism 69) centered on the axis line of the support axis 71 which is orthogonal to (intersects with) the transport direction of the wiping member 54.

The second contact portion 75 does not necessarily have a smaller friction coefficient than the first contact portion 74.

The corner portion which includes the linear portion 74*a* in the first contact portion 74 may be rounded.

The support plate 70 of the pressing mechanism 69 may be rotated by a driving source such as a motor.

Wiping of the nozzle surface 39 by the wiping device 26 may be performed by moving the nozzle surface 39 in a state in which the wiping device 26 is stationary. In this case, it is sufficient if the first contact portion 74 is disposed so as to be closer to the support member 13 than the second contact portion 75 in a direction in which the wiping device 26 is moved along the sub-scanning direction Y by the feeding shaft 53. In addition, after the nozzle surface 39 is wiped, when the nozzle surface 39 is moved in a direction to the support member 13 side, the support plate 70 of the pressing mechanism 69 may be rotated by a drive source such as a motor at a direction in which the wiping member 54 does not contact the nozzle surface 39.

Wiping of the nozzle surface 39 by the wiping device 26 may be performed by moving both of the wiping device 26 and the nozzle surface 39.

The ink jet printer 11 may be a line head type which is not provided with the carriage 17 that supports the liquid ejecting head 22, and which is provided with a line head with the printing range across the entire width of the recording medium P. In this case, since the line head is fixed and does not move, the nozzle surface is wiped by moving the wiping device.

In the embodiment, the liquid ejecting apparatus may be a liquid ejecting apparatus that ejects and discharges another liquid other than ink. Note that, the state of the liquid which is discharged in a liquid droplet in a very small amount from the liquid ejecting apparatus is set to include pulling out in a tail a granular shape, a tear shape, and a yarn shape. In addition, the liquid here may be a material such that it is possible to eject from the liquid ejecting apparatus. For example, it is sufficient if the material is in a state when a substance is in a liquid phase, and the material includes a fluid state body such as a liquid state body having high or low viscosity, a sol, a gel, and other materials such as an inorganic solvent, an organic solvent, a solution, a liquid state resin, and a liquid metal (molten metal). In addition, the state of the substance is not limited only to liquid, and a substance where particles of a functional material made from a solid substance such as a pigment or metallic particles are dissolved, dispersed, mixed, or the like in a solvent are included. As a representative example of liquid examples are given such as ink and liquid crystal which are described in the embodiment described above. Here, ink contains various types of liquid-form compositions such as a typical water-based ink, oil-based ink, gel ink, and hot melt ink. As a specific example of the liquid ejecting apparatus, for example, there is a liquid ejecting apparatus which ejects liquid that includes a material such as an electrode material or a color material which is used in manufacture and the like of a liquid crystal display, an electro-luminescence (EL) display, a surface light emission display, and a color filter in a dispersed or dissolved form. In addition, the apparatus may be a liquid ejecting apparatus which ejects a bio-organic material that is used in biochip manufacture, a liquid ejecting apparatus which ejects liquid that is a sample that is used as a precision pipette, a textile printing apparatus, a micro dispenser, and the like. Furthermore, the apparatus may be a liquid ejecting apparatus which ejects lubricant oil with pinpoint precision in precision machinery such as a watch or a camera, a liquid ejecting apparatus which ejects a transparent resin liquid such as an ultraviolet curable resin on a substrate in order to form a micro-spherical lens (an optical lens) which is used in an optical communication element or the like, and the like. In addition, the apparatus may be a liquid ejecting apparatus which ejects acidic or alkaline etching liquid in order to carry out etching on a substrate or the like.

What is claimed is:

1. A liquid ejecting apparatus comprising:

a liquid ejecting head which ejects liquid from a nozzle that is disposed on a nozzle surface;

a wiping member with a lengthwise shape which is able to wipe away the liquid which is adhered to the nozzle surface by contacting the nozzle surface;

a transport mechanism which transports the wiping member;

a first contact portion configured to contact an opposite side from a side at which the wiping member contacts the nozzle surface when the wiping member is caused to contact the nozzle surface;

a second contact portion which contacts the opposite side of the wiping member when the wiping member is transported by the transport mechanism, the second contact portion being disposed on an upstream side than the first contact portion in the direction in which the wiping member is transported; and a cleaning liquid supply portion which supplies cleaning liquid to the wiping member, the cleaning liquid supply portion is disposed more on the upstream side than the second contact portion in a direction in which the wiping member is transported, wherein the transport mechanism includes a guide roller disposed on the upstream side than the cleaning liquid supply portion in the direction in which the wiping member is transported, and the guide roller contacts the side of the wiping member.

2. The liquid ejecting apparatus according to claim 1, wherein the second contact portion has a smaller friction coefficient than the first contact portion.

3. The liquid ejecting apparatus according to claim 1, wherein the first contact portion and the second contact portion are included on a same contact unit such that the first contact portion and the second contact portion form parts of the same contact unit.

4. The liquid ejecting apparatus according to claim 1, wherein the first contact portion is separated from the wiping member when the wiping member is transported by the transport mechanism.

5. The liquid ejecting apparatus according to claim 1, wherein the liquid ejecting head discharges the liquid toward the side of the wiping member.

6. The liquid ejecting apparatus according to claim 5, wherein the liquid ejecting head discharges the liquid toward a region of the wiping member located on a downstream side than the first contact portion in the direction in which the wiping member is transported.

7. The liquid ejecting apparatus according to claim 1, wherein the cleaning liquid supply portion ejects the cleaning liquid to the wiping member from a position away from the wiping member.

8. A cleaning device comprising:

a wiping member with a lengthwise shape that is able to wipe away liquid that is adhered to a nozzle surface by contacting the nozzle surface of a liquid ejecting head which ejects the liquid from a nozzle that is disposed on the nozzle surface;

a transport mechanism which transports the wiping member;

a first contact portion configured to contact an opposite side from a side at which the wiping member contacts the nozzle surface when the wiping member is caused to contact the nozzle surface;

a second contact portion which contacts the opposite side of the wiping member when the wiping member is transported by the transport mechanism, the second contact portion being disposed on an upstream side than the first contact portion in the direction in which the wiping member is transported; and a cleaning liquid supply portion which supplies cleaning liquid to the wiping member, the cleaning liquid supply portion is disposed more on the upstream side than the second contact portion in a direction in which the wiping member is transported, wherein the transport mechanism includes a guide roller disposed on the upstream side than the cleaning liquid supply portion in the direction in which the wiping member is transported, and the guide roller contacts the side of the wiping member.

9. The cleaning device according to claim 8, wherein the second contact portion has a smaller friction coefficient than the first contact portion.

10. The cleaning device according to claim 8, wherein the first contact portion and the second contact portion are included on a same contact unit such that the first contact portion and the second contact portion form parts of the same contact unit.

11. The cleaning device according to claim 8, wherein the first contact portion is separated from the wiping member when the wiping member is transported by the transport mechanism.

12. The cleaning device according to claim 8, wherein the first contact portion is separated from the wiping member when the wiping member is caused to contact the nozzle surface.

13. A liquid ejecting apparatus comprising:

a liquid ejecting head which ejects liquid from a nozzle that is disposed on a nozzle surface;

a wiping member with a lengthwise shape which is able to wipe away the liquid which is adhered to the nozzle surface by contacting the nozzle surface;

a transport mechanism which transports the wiping member;

a first contact portion configured to contact an opposite side from a side at which the wiping member contacts the nozzle surface when the wiping member is caused to contact the nozzle surface;

a second contact portion configured to contact the opposite side of the wiping member when the wiping member is transported by the transport mechanism, the second contact portion moving integrally with the first contact portion; and a cleaning liquid supply portion which supplies cleaning liquid to the wiping member, the cleaning liquid supply portion is disposed more on the upstream side than the second contact portion in a direction in which the wiping member is transported when the cleaning liquid is supplied to the wiping member.

14. The liquid ejecting apparatus according to claim 13, further comprising:

a supporting portion which supports the first contact portion and the second contact portion, the supporting portion being disposed along the wiping member to be rotatable centered on an axis line which intersects with a transport direction of the wiping member, wherein a first contact state of the first contact portion contacting the opposite side and a second contact state of the second contact portion contacting the opposite side are switched by rotating the supporting portion centered on the axis line.

15. The liquid ejecting apparatus according to claim 14, wherein a distance between the first contact portion and the axis line is different from a distance between the second contact portion and the axis line.

16. The liquid ejecting apparatus according to claim 13, further comprising:

a rotating portion which is disposed along the wiping member to be rotatable centered on an axis line which intersects with a transport direction of the wiping member, wherein the first contact portion and the second contact portion are provided on a circumferential surface of the rotating portion.

* * * * *